US005558245A

United States Patent [19]

White

[11] Patent Number: 5,558,245

[45] Date of Patent: Sep. 24, 1996

[54] STORAGE TANK BLADDER SEAL

[76] Inventor: Steven P. White, 200 Center Plz., Ste. 1423, Tulsa, Okla. 74119

[21] Appl. No.: 309,402

[22] Filed: Sep. 20, 1994

[51] Int. Cl.[6] ..... B65D 8/00

[52] U.S. Cl. ..... 220/403; 220/565

[58] Field of Search ..... 220/403, 420, 220/426, 723, 901, 460, 461, 565

[56] References Cited

U.S. PATENT DOCUMENTS

| | | | |
|---|---|---|---|
| 1,002,271 | 7/1911 | Hill et al. | 220/403 X |
| 2,793,669 | 5/1957 | Clarke | 220/403 X |
| 2,794,570 | 6/1957 | Downs | 220/403 |
| 3,167,209 | 1/1965 | Jones | 220/403 X |
| 3,882,591 | 5/1975 | Yamamoto | 220/901 X |
| 4,117,947 | 10/1978 | Androulakis | 220/403 X |

*Primary Examiner*—Steven M. Pollard

*Attorney, Agent, or Firm*—Frank J. Catalano; Scott R. Zingerman

[57] ABSTRACT

A bladder mounting for a storage tank has a plurality of threaded studs, spaced circumferentially along an upper portion of an inner surface of the tank side wall. At least one layer of geotextile padding, is adhered to the inner surface of the wall below the studs. A liner with a reinforced hem has circumferentially spaced apertures which receive the studs and suspend the liner within the tank. A circumferential band of adhesive material along the studs and apertures and between the wall and the liner seals the liner to the inner surface of the tank along a continuous path. A circumferential strip of battan has spaced apertures to receive the studs for clamping the liner against the inner surface of the wall with the band of adhesive therebetween. Nuts and washers engage with the threaded studs and draw the battan toward the wall to secure the seal along the continuous path. At least one relief valve extends through the wall proximate and below the seal and pneumatically communicates from a cavity defined by the wall and the liner to the atmosphere external of the tank. Consequently, as the tank is filled with material to be stored, gases trapped between the wall and the liner and below the seal are released to atmosphere through the relief valve. The seal prevents overflow between the tank wall and the liner and the valve permits the liner to come into abutment with the padding on the tank wall, minimizing the possibility of condensation therebetween.

18 Claims, 5 Drawing Sheets

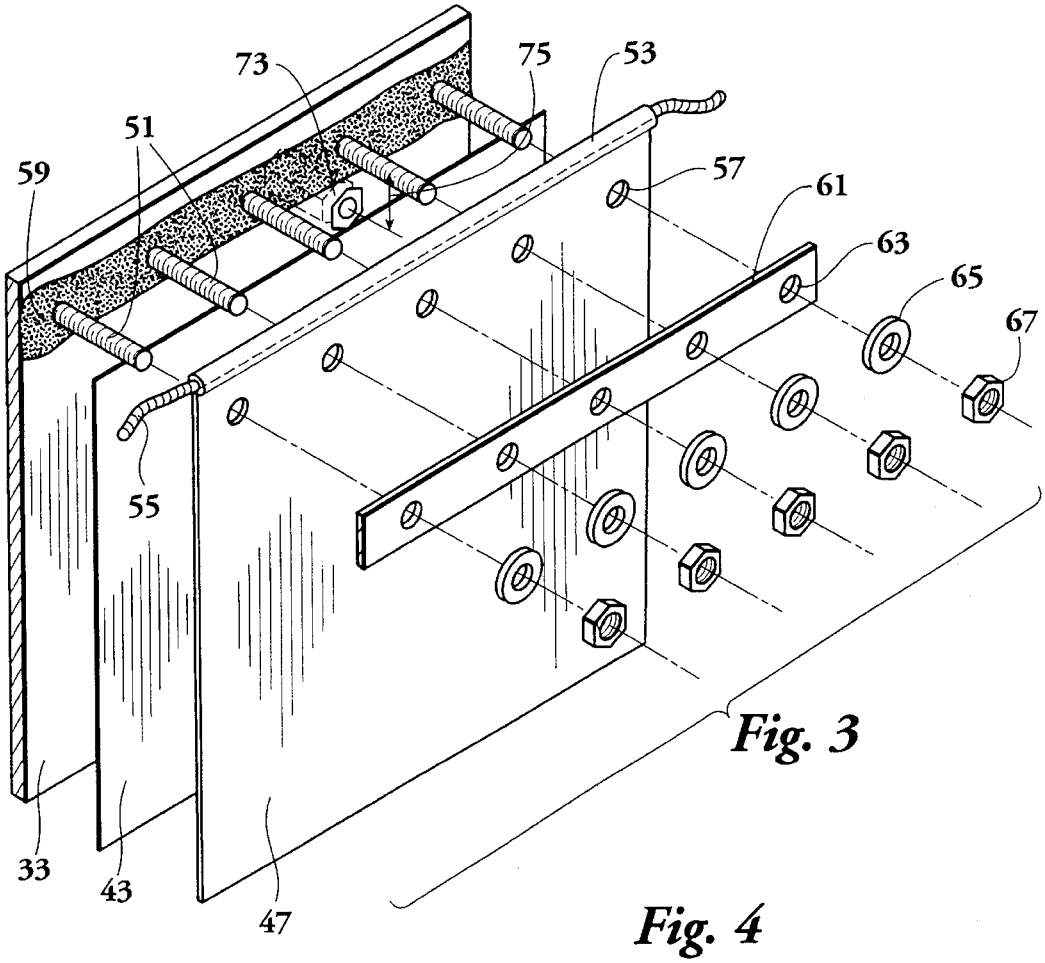
Fig. 3
Fig. 4
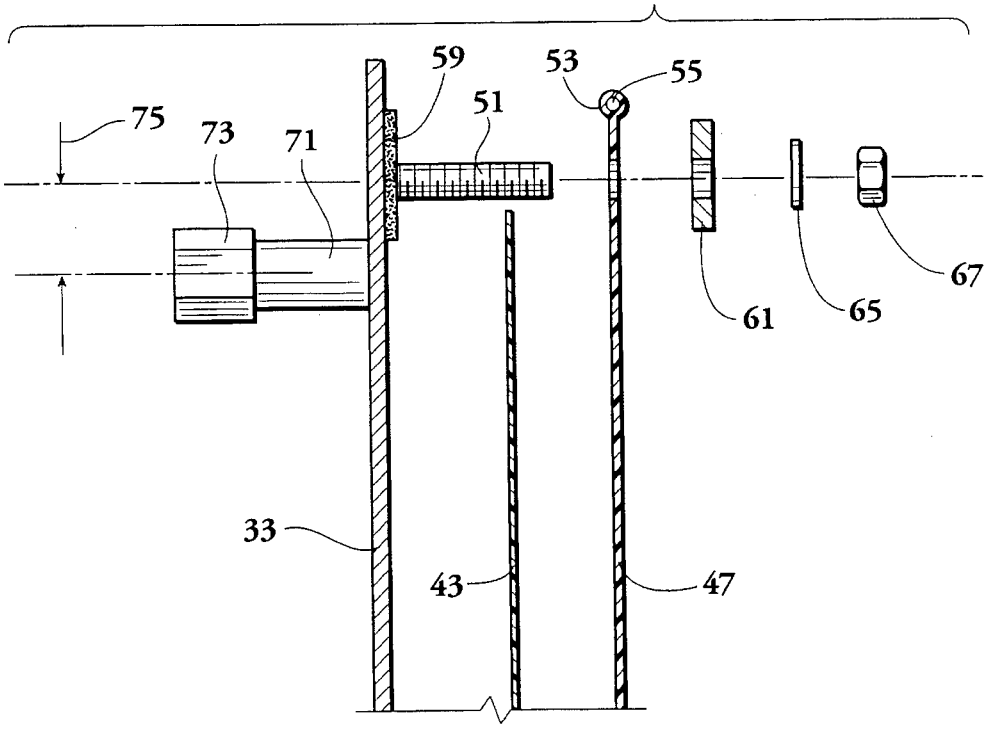

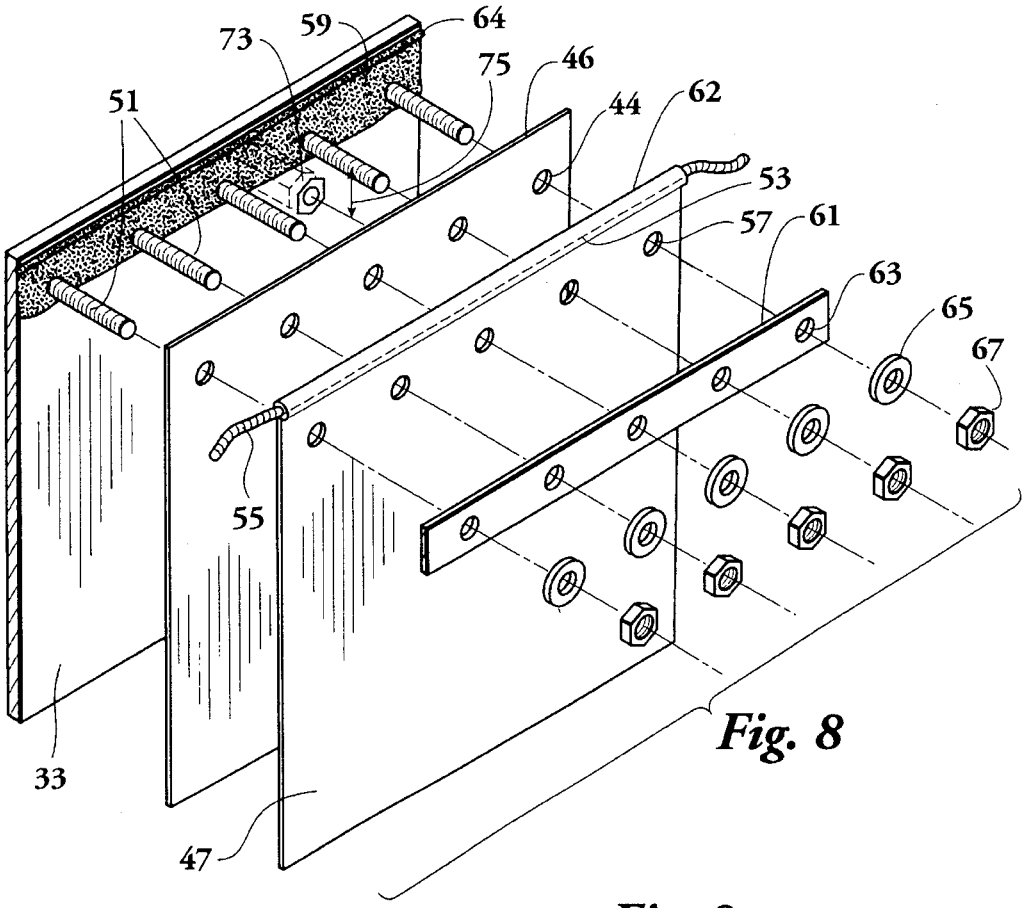
Fig. 8
Fig. 9
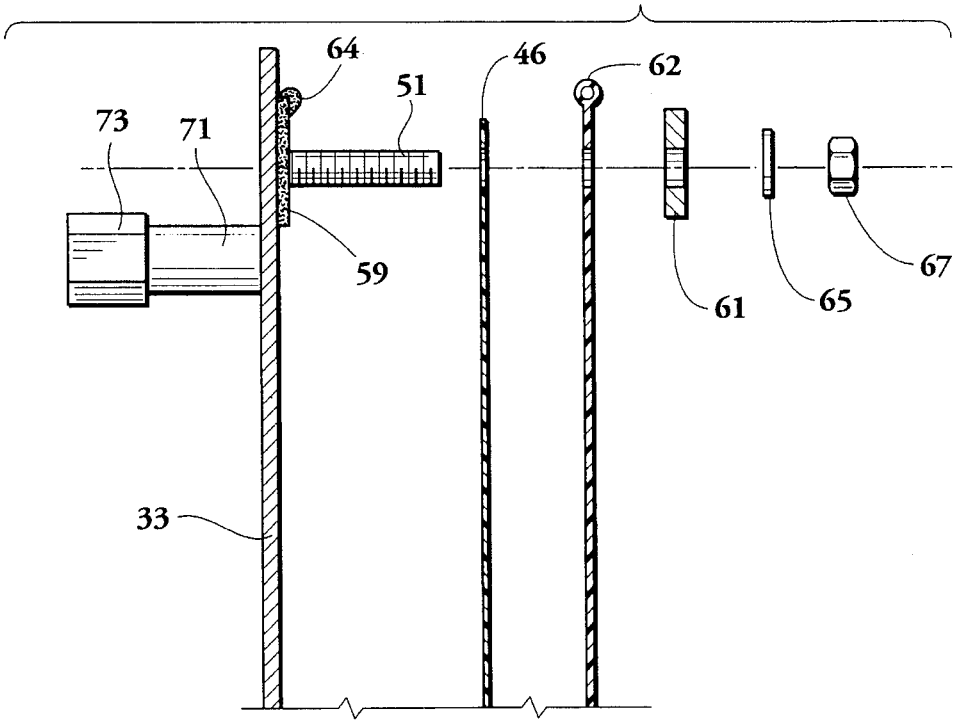

STORAGE TANK BLADDER SEAL

BACKGROUND OF THE INVENTION

This invention relates generally to storage tanks and more particularly concerns the mounting of bladders used to line tanks storing fertilizer and other corrosive materials.

Tanks used for storing fertilizer, oil, petro chemicals and the like are presently lined by suspending a bladder of unreinforced PVC or other material suited to the specific application from J-hooks mounted along the upper interior periphery of the tank. In such arrangements, the bladder is spaced inwardly from the tank sidewalls by as much as 2 inches and to the base portion of the bladder which rests on a bed of sand at the bottom of the tank. One ton of sand for every foot of diameter of the tank is distributed over the bottom of the tank and under the bladder. Since the bladder is spaced inwardly from the tank, condensation builds up between the tank wall and the bladder and causes the tank to corrode. In addition, overfill above the level of the J-hooks supporting the bladder in the tank causes the highly corrosive stored material to flow over the bladder and between the tank and bladder to the sand below. The sand must then be replaced. In a fifty foot diameter tank, this involves the removal and replacement of some fifty tons of sand. Many tanks are up to 200 feet in diameter. The down time and costs of tank repair and sand replacement can clearly be quite burdensome.

It is, therefore, an object of this invention to provide a storage tank bladder seal which minimizes the occurrence of condensation between the tank wall and the bladder. A further object of this invention is to provide a storage tank bladder seal which eliminates spacing between the upper peripheral portions of the tank and the bladder. Another object of this invention is to provide a storage tank bladder seal which minimizes the possibility of overfill materials penetrating between the tank and the bladder. Similarly, it is an object of this invention to provide a storage tank bladder seal which will minimize the possibility of the tank contents contaminating the sand base at the bottom of the tank. Collaterally, it is an object of this invention to eliminate the use of sand as a base material in the tank.

SUMMARY OF THE INVENTION

In accordance with the invention, a bladder mounting for a storage tank has a plurality of threaded studs, preferably of stainless steel, spaced circumferentially, preferably on approximately twelve inch centers, along an upper portion of an inner surface of the tank side wall. At least one layer of padding, such as geotextile, is adhered to the inner surface of the wall below the studs. A liner with a reinforced hem along its upper edge has a plurality of circumferentially spaced apertures receiving the studs to suspend the liner within the tank. A circumferential band of adhesive material along the studs and apertures and between the wall and the liner seals the liner to the inner surface of the tank along a continuous path. A circumferential strip of battan with circumferentially spaced apertures receives the studs for clamping the liner against the inner surface of the wall with the band of adhesive therebetween. A plurality of nuts and washers, preferably stainless steel, engage with the threaded studs and draw the battan toward the wall to secure the seal along the continuous path. At least one relief valve, and preferably two in diametric alignment, extends through the wall proximate and below the seal, preferably 1 to 3 inches below the centerlines of the studs, and pneumatically communicates from a cavity defined by the wall and the liner to the atmosphere external to the tank. Consequently, as the tank is filled with material to be stored, gases trapped between the wall and the liner and below the seal are released to atmosphere through the relief valve.

The seal prevents overflow between the tank wall and the liner and the valve permits the liner to come into abutment with the padding on the tank wall, minimizing the possibility of condensation therebetween.

Preferably, at least one layer, and optimally two, of geotextile padding will be disposed between a bottom of the tank and a bottom portion of the bladder in place of the presently used sand base. Should the geotextile be contaminated, it is relatively easily rolled up and disposed of, unlike the presently used bed of sand.

BRIEF DESCRIPTION OF THE DRAWINGS

Other objects and advantages of the invention will become apparent upon reading the following detailed description and upon reference to the drawings in which:

FIG. 3 is a fragmentary perspective assembly view illustrating the bladder mounting area A of FIG. 2;

FIG. 4 is a side elevation view of the bladder mounting illustrated in FIG. 3;

FIG. 8 is a fragmentary, perspective assembly view illustrating a variation in the bladder mounting of FIG. 3; and FIG. 9 is a side elevation view of the bladder mounting illustrated in FIG. 8.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
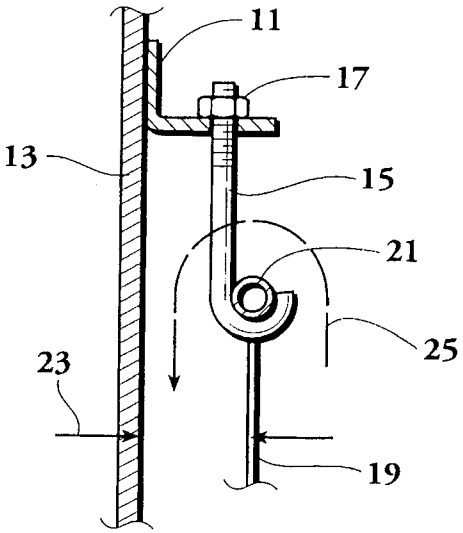
Fig. 1 ( PRIOR ART )
FIG. 1 is a sectional view illustrating mounting of a bladder within a storage tank using the prior art J-hook method.

Turning first to FIG. 1, the prior art method of mounting a bladder within a storage tank is illustrated. As shown, an angle iron 11 is welded to the steel tank wall 13. J-hook 15 suspended through an aperture in the angle iron is secured in place by a nut 17 on the upper end of the J-hook 15. The liner 19 forming the upper portion of the bladder is suspended from the J-hook 15 by a pipe 21 along the upper edge of the liner 19. In this arrangement, the typical spacing 23 between the tank wall 13 and the liner 19 is approximately one to two inches, thus providing a sizable pocket in which condensation can collect and cause rust in the tank wall 13. In addition, if the tank is overfilled, corrosive materials 25 will pour over the liner 19 and pass between the liner 19 and the tank wall 13 to the sand at the base of the tank pad.

Figure 2:
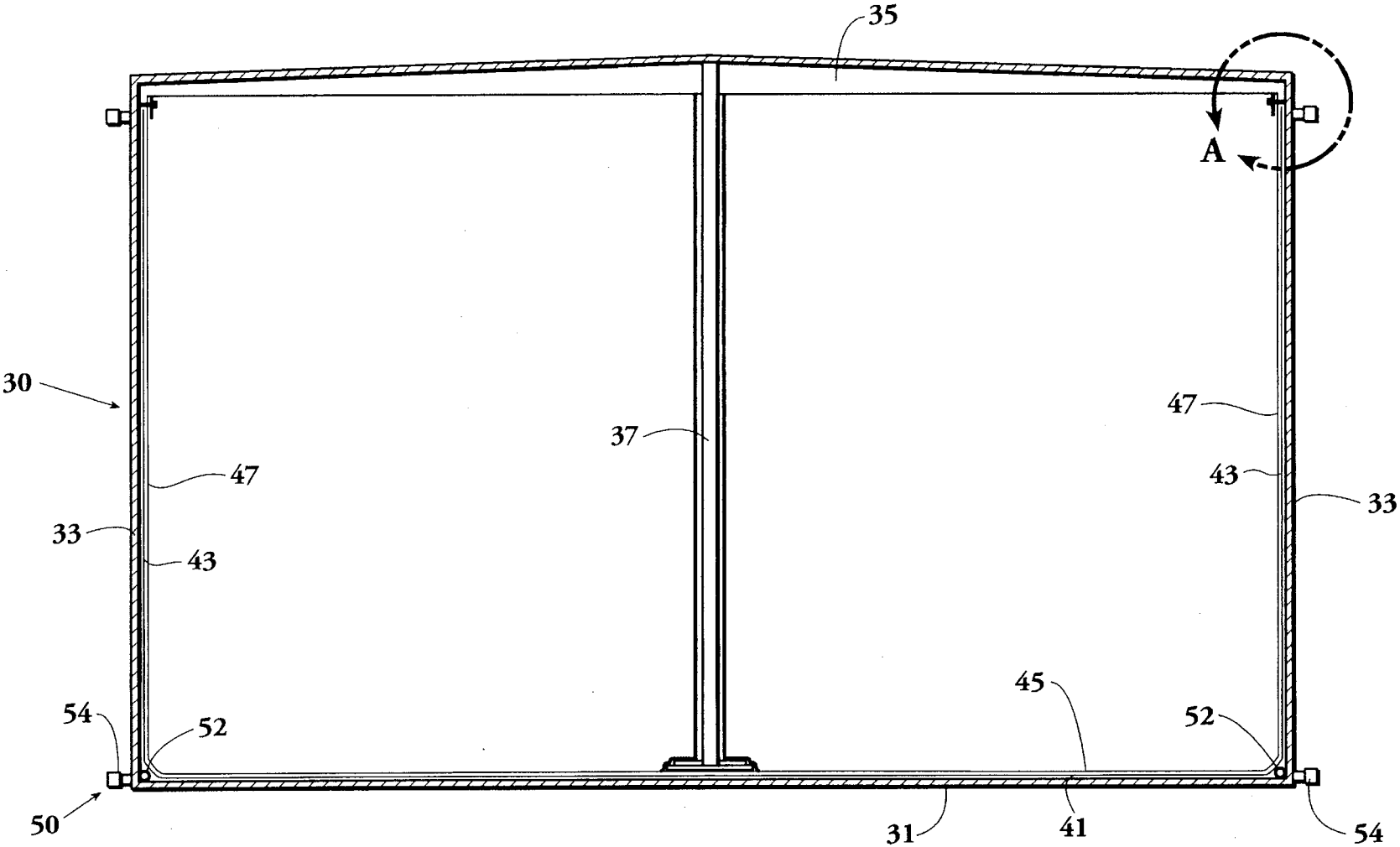
FIG. 2 is a diametric sectional view of a storage tank with a bladder mounted therein in accordance with the present invention.

Looking now at FIG. 2, a typical flat bottom storage tank 30 is illustrated. The tank 30 has a steel bottom 31 and sidewalls 33 extending up to the tank roof 35. The roof is supported by a plurality of columns 37, the center one of which is shown. In the practice of the present invention, the tank bottom 31 will be covered with one or more layers of geotextile 41 and the tank sidewalls will also be covered with one or more layers of geotextile 43 adhered to the tank 30. The bladder will be formed from a liner base portion 45, such as a 60 mil unsupported PVC liner, and a liner sidewall portion 47, such as a 30 mil supported PVC liner. A leak detection system 50 will also be provided in the bottom of the tank 30 between the tank bottom 31 and the geotextile 41.

Turning now to FIGS. 3 and 4, a preferred embodiment of the mounting of the bladder to the tank 30 is illustrated. As shown, a plurality of studs 51, preferably of stainless steel, are welded to the upper inside surface of the tank wall 33, preferably extending radially inwardly toward the center of the tank and on equal spaced centers about the circumference of the tank 30. Preferably, the studs 51 will be on approximately twelve inch centers and will be threaded. A geotextile padding 43 is applied to the inner surface of the steel tank wall 33 using an appropriate adhesive so that the padding 43 extends downwardly on the tank wall 33 from a circumference below the circumference on which the studs 51 are aligned. The sidewalls of the bladder formed by the liner 47 have a reinforced hem 53 about their upper circumference, the reinforcement perhaps consisting of a polyrope hem 55 disposed between overlapped layers of the liner 47. The liner 47 also has a plurality of apertures 57 disposed beneath the reinforced hem 53 and spaced to receive the studs 51 therethrough so as to suspend the liner 47 within the tank 30. A band of adhesive 59 suitable for bonding the liner 47 to the tank wall 33 is applied in a continuous path along the studs 51 and apertures 57 so as to form a continuous tight seal between the tank wall 33 and the liner 47 about the entire periphery of the tank 30. Strips of battan 61 having apertures 63 therethrough and aligned to receive the studs 51 therein clamp the liner 47 against the tank wall 33. Stainless steel washers 65 and nuts 67 are used to draw the battan 61 toward the tank wall 33 so as to secure the seal along the band of adhesive 59. To exhaust gases trapped between the tank wall 33 and the liner 47 as the liner is compressed upwardly and adjacent the tank wall 33 and padding 43 under the pressure of the stored tank contents as they are introduced into the tank 30, a section of threaded pipe 71 is connected to the tank wall 33 and a vacuum relief valve 73 mounted on the pipe 71. The pipe 71 and relief valve 73 will be below the studs 51, preferably a distance 75 of approximately one to three inches. The pipe 71 and relief valve 73 provide pneumatic communication from the space or cavity defined by the tank wall 33 and the liner 47 to the atmosphere external to the tank 30. As shown in FIG. 2, it is preferred that two such valves 73 be provided in diametric alignment but any number of such valves may be employed, preferably on substantially equal spacing, as may be required in a given tank application.

Figure 6:
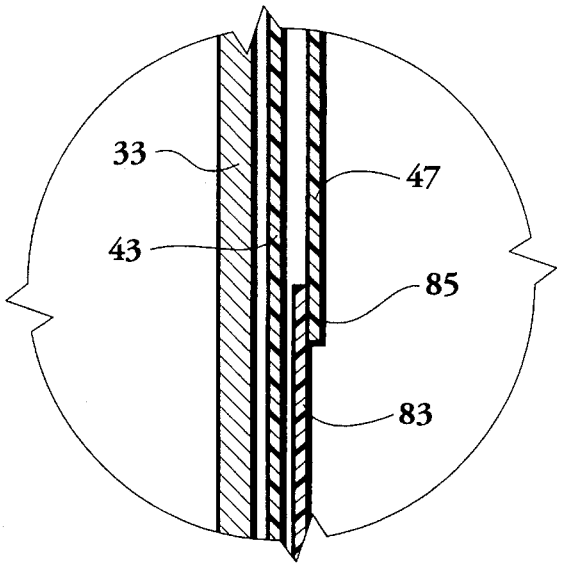
FIG. 6 is an enlarged sectional view of the area B of FIG. 5.
Figure 5:
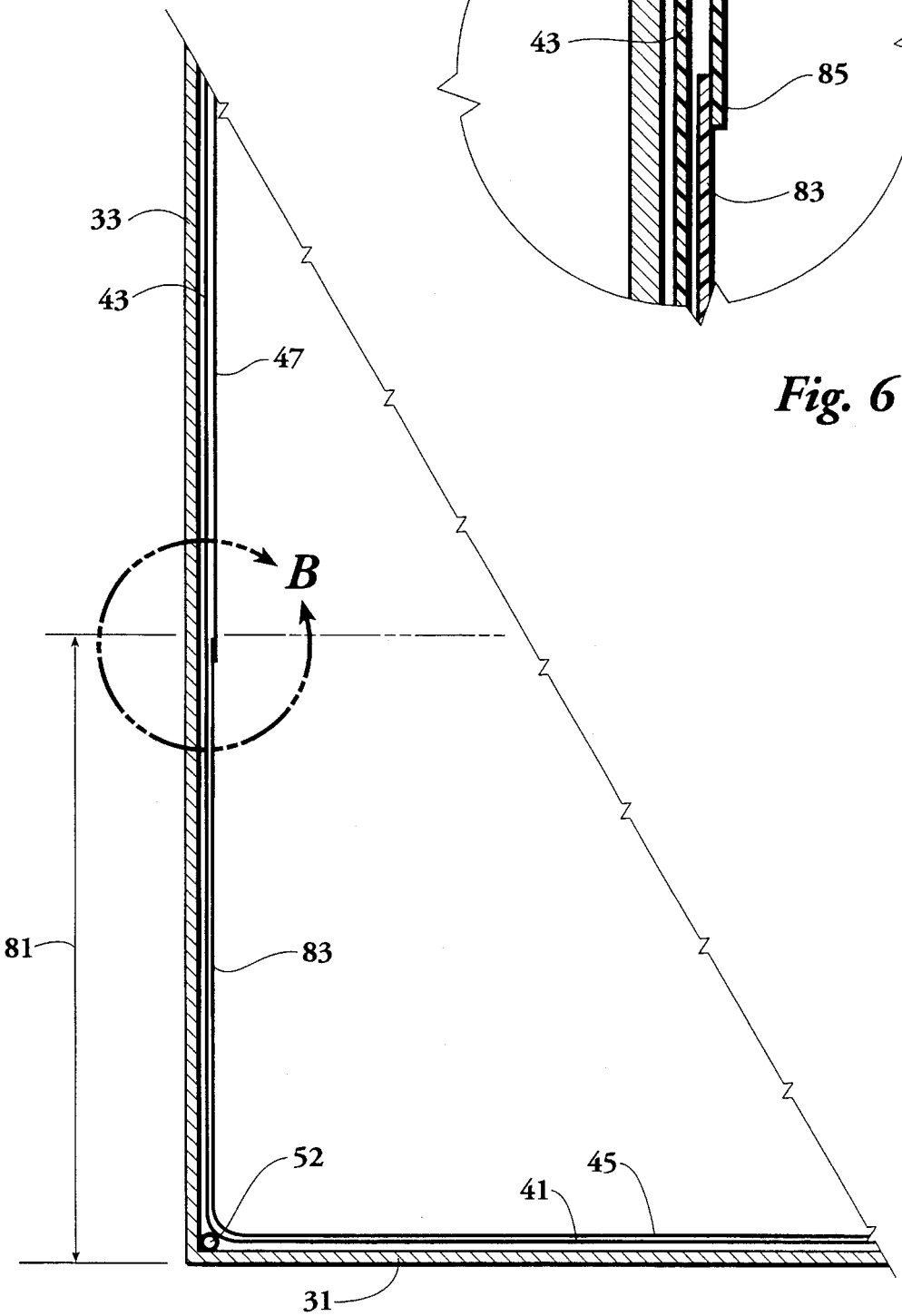
FIG. 5 is a partial diametric cross-sectional view illustrating the arrangement of the bladder in the tank bottom according to a preferred embodiment of the invention.

Turning now to FIGS. 5 and 6, the completion of the bladder arrangement can be understood. The upper or sidewall portion of the liner 47 extends along the geotextile padding 43 which is adhered to the steel tank wall 33. Near the lower portion of the tank 30, preferably at a distance 81 of approximately eight feet above the bottom 31 of the tank, the lower portion of the liner 83 continues downwardly along the geotextile 43 and then extends across the bottom of the tank 31 above the bottom geotextile 41. As can best be seen in FIG. 6, the upper liner 47 overlaps the lower liner 83, preferably with approximately a one and one-half inch overlap, and they are connected at the overlap by a dielectric welded seam 85.

Figure 7:
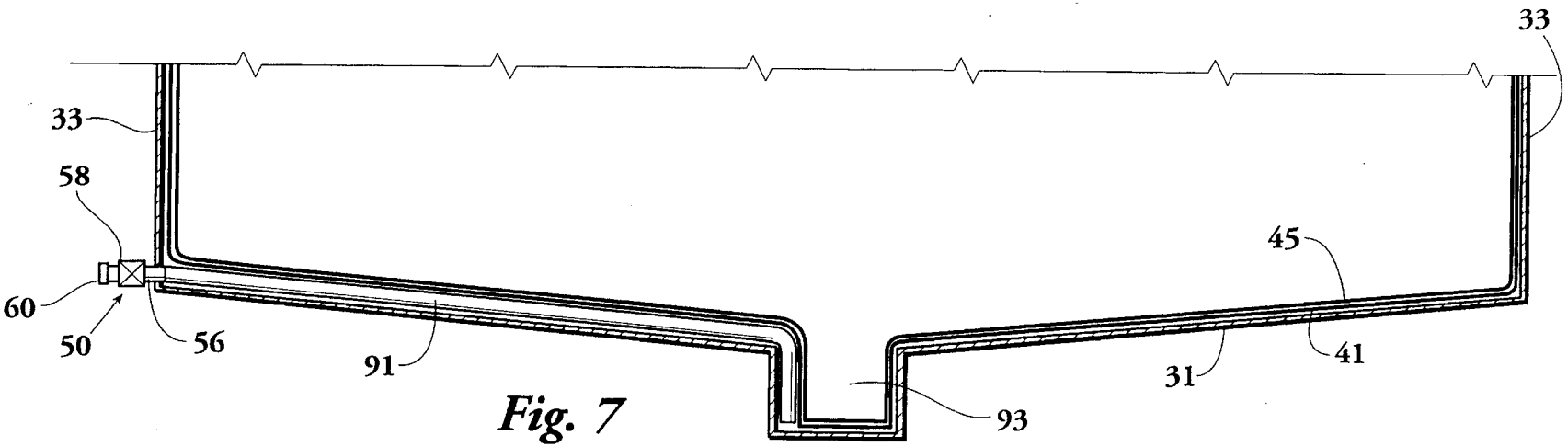
FIG. 7 is a diametric sectional view illustrating the arrangement of a bladder in the tank bottom of a "cone-down" tank.

As can be seen in FIGS. 2 and 5, in a flat bottom tank 30, the leak detection system 50 will consist of a circumferential slotted monitor pipe 52 disposed between the geotextile 41 and the tank bottom 31, the pipe 52 being connected to the valves 54 extending externally of the tank 30. The connection of the valves 54 to the leak detection 50 is illustrated in greater detail in FIG. 7 which shows a leak detection system for use in conjunction with a cone-down tank. In the arrangement shown, a one inch, 2,000 psi bulkhead fitting 56 connects to a one inch stainless steel ball valve 58 with a one inch cap 60. In the cone-down tank arrangement, a single radial section of monitor pipe 91 extends from the valve 58 radially into a sump 93 at the center of the tank 30. While it is preferred to use two valves 54 in the flat bottom tank illustrated in FIGS. 2 and 5 or in cone-up tanks (not shown), both of which employ the circumferential monitor pipe 52, in the cone-down tank arrangement, a single radial section of monitor pipe 91 to one ball valve 58 is sufficient.

Turning now to FIGS. 8 and 9, a specially preferred variation of the mounting of the bladder to the tank 30 is illustrated which is, in almost all respects, the same as the mounting illustrated in FIGS. 3 and 4, except that the geotextile padding 43 is provided a plurality of apertures 44 so that it is suspended from the studs 51 in addition to being adhered to the tank sidewall 33. The padding apertures 44 are provided along a circumferential path more proximate the top edge 46 of the padding 43 than the liner apertures 57 are to the top edge 62 of the liner 47. Consequently, the band of adhesive 59 still provides a continuous seal between the tank wall 33 and the liner 47 immediately above the studs 51. To further assure a complete seal, a continuous bead of caulking 64 can be provided above the band of adhesive 59 and between the tank wall 33 and the reinforced hem 53 of the liner 47.

By use of either of the above alternative mounting arrangements, as the tank 30 is filled with material to be stored, the liner 47 will be sealed against the padded tank side wall 33 so that gases therebetween will be forced upwardly to the upper portion of the bladder where they will be exhausted through the relief valve 73, thus minimizing the possibility of condensation between the tank wall 33 and the liner 47. In addition, since a complete and continuous seal is achieved along the band of adhesive 59 between the tank wall 33 and the liner 477, the possibility of overflow of stored corrosive materials over the lip of the bladder and between the tank wall 33 and the liner 477 is minimized.

The materials used for the liner 41 and 47, the battan 61 and the adhesive band 59 will of course be selected based on the specific tank application, as will the spacing and number of studs 51 and relief valves 73. It has been presently found that one inch, low pressure, high velocity, 7 psi valves are suitable for the purpose.

Thus, it is apparent that there has been provided, in accordance with the invention, a storage tank bladder seal that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A bladder mounting for a storage tank comprising:

a liner;

a circumferential band of adhesive material between an inner wall of said tank and said liner forming a seal of said liner to said tank wall along a continuous path;

means for clamping said liner against said inner surface of said wall with said band of adhesive therebetween; and at least one pneumatically operated automatic relief valve through said wall proximate and below said seal for pneumatic communication from a cavity between said wall and said liner to atmosphere external to said tank whereby, as said tank is filled with material to be stored, gases trapped between said wall and said liner and below said seal are automatically released to atmosphere through said at least one relief valve.

2. A bladder mounting for a storage tank comprising:

a plurality of studs spaced circumferentially along an upper portion of an inner surface of a wall of the tank;

a liner having a plurality of apertures spaced circumferentially under an upper edge thereof and receiving said studs therethrough for suspending said liner within the tank;

a circumferential band of adhesive material along said studs and said apertures and between said wall and said liner forming a seal of said liner to said inner surface of said tank wall along a continuous path;

a circumferential strip of battan having apertures spaced circumferentially thereabout and receiving said studs therethrough for clamping said liner against said inner surface of said wall with said band of adhesive therebetween;

a plurality of means engagable with said studs for drawing said battan toward said wall with said band of adhesive and said liner therebetween to secure said seal along said continuous path; and at least one pneumatically operated automatic relief valve through said wall proximate and below said seal for pneumatic communication from a cavity between said wall and said liner to atmosphere external to said tank whereby, as said tank is filled with material to be stored, gases trapped between said wall and said liner and below said seal are automatically released to atmosphere through said at least one relief valve.

3. A mounting for a storage tank comprising:

a plurality of studs spaced circumferentially along an upper portion of an inner surface of a wall of the tank;

at least one layer of padding adhered to said inner surface of said wall below said studs;

a liner having a plurality of apertures spaced circumferentially under an upper edge thereof and receiving said studs therethrough for suspending said liner within the tank;

a circumferential band of adhesive material along said studs and said apertures and between said wall and said liner forming a seal of said liner to said inner surface of said tank wall along a continuous path;

a circumferential strip of battan having apertures spaced circumferentially thereabout and receiving said studs therethrough for clamping said liner against said inner surface of said wall with said band of adhesive therebetween;

a plurality of means engagable with said studs for drawing said battan toward said wall with said band of adhesive and said liner therebetween to secure said seal along said continuous path; and at least one pneumatically operated automatic relief valve through said wall proximate and below said seal for pneumatic communication from a cavity between said wall and said liner to atmosphere external to said tank whereby, as said tank is filled with material to be stored, gases trapped between said wall and said liner and below said seal are released to atmosphere through said at least one relief valve.

4. A bladder mounting for a storage tank comprising:

a plurality of threaded studs spaced circumferentially along an upper portion of an inner surface of a wall of the tank;

at least one layer of padding and adhesive securing said padding to said inner surface of said wall below said studs;

a liner having a reinforced hem along its upper edge and a plurality of apertures spaced circumferentially thereunder and receiving said studs therethrough for suspending said liner within the tank;

a circumferential band of adhesive material along said studs and said apertures and between said wall and said liner to form a seal of said liner to said inner surface of said tank wall along a continuous path;

a circumferential strip of battan having apertures spaced circumferentially thereabout and receiving said studs therethrough for clamping said liner against said inner surface of said wall with said band of adhesive therebetween;

a plurality of means engagable with said threaded studs for drawing said battan toward said wall with said band of adhesive and said liner therebetween to secure said seal along said continuous path; and at least one pneumatically operated automatic relief valve through said wall proximate and below said seal for pneumatic communication from a cavity between said wall and said liner to atmosphere external to said tank whereby, as said tank is filled with material to be stored, gases trapped between said wall and said liner and below said seal are released to atmosphere through said at least one relief valve.

5. A mounting according to claim 4, said studs being substantially equally spaced apart.

6. A mounting according to claim 5, said studs being spaced on approximately twelve inch centers.

7. A mounting according to claim 4, said at least one relief valve being approximately 1 to 3 inches below a centerline of said studs.

8. A mounting according to claim 4 having a plurality of relief valves approximately equally spaced apart.

9. A mounting according to claim 4 having two approximately diametrically aligned relief valves.

10. A mounting according to claim 4 further comprising at least one layer of geotextile padding between a bottom of the tank and a bottom portion of the bladder.

11. A bladder mounting for a storage tank comprising:

a plurality of threaded studs spaced circumferentially along an upper portion of an inner surface of a wall of the tank;

at least one layer of padding having a plurality of apertures spaced circumferentially below an upper edge thereof and receiving said studs therethrough for suspending said padding within the tank and adhesive securing, said padding to said inner surface of said wall below said studs;

a liner having a reinforced hem along its upper edge and a plurality of apertures spaced circumferentially thereunder and receiving said studs therethrough for suspending said liner within the tank with said liner upper edge above said padding upper edge;

a circumferential band of adhesive material along said studs and said apertures and between said wall and said liner to form a seal of said liner to said inner surface of said tank wall along a continuous path above said padding upper edge;

a circumferential strip of battan having apertures spaced circumferentially thereabout and receiving said studs therethrough for clamping said liner against said inner surface of said wall with said band of adhesive therebetween;

a plurality of means engagable with said threaded studs for drawing said battan toward said wall with said band of adhesive and said liner therebetween to secure said seal along said continuous path; and at least one pneumatically operated automatic relief valve through said wall proximate and below said seal for pneumatic communication from a cavity between said wall and said liner to atmosphere external to said tank whereby, as said tank is filled with material to be stored, gases trapped between said wall and said liner and below said seal are released to atmosphere through said at least one relief valve.

12. A mounting according to claim 11, said studs being substantially equally spaced apart.

13. A mounting according to claim 12, said studs being spaced on approximately twelve inch centers.

14. A mounting according to claim 12, said at least one relief valve being approximately 1 to 3 inches below a centerline of said studs.

15. A mounting according to claim 12 having a plurality of relief valves approximately equally spaced apart.

16. A mounting according to claim 12 having two approximately diametrically aligned relief valves.

17. A mounting according to claim 12 further comprising at least one layer of geotextile padding between a bottom of the tank and a bottom portion of the bladder.

18. A mounting according to claim 11 further comprising a continuous bead of caulking between said tank wall and said liner above said band of adhesive.

* * * * *